US008672361B2

(12) United States Patent
Lazzerini

(10) Patent No.: US 8,672,361 B2
(45) Date of Patent: Mar. 18, 2014

(54) SECURITY ELEMENT FOR BANKNOTES OR DOCUMENTS WITH INTRINSIC VALUE

(75) Inventor: Maurizio Lazzerini, Cerro Al Lambro (IT)

(73) Assignee: Fedrigoni S.p.A., Verona (IT)

( * ) Notice: Subject to any disclaimer, the term of this patent is extended or adjusted under 35 U.S.C. 154(b) by 475 days.

(21) Appl. No.: 12/083,154

(22) PCT Filed: Feb. 27, 2006

(86) PCT No.: PCT/IB2006/000464
§ 371 (c)(1),
(2), (4) Date: Apr. 4, 2008

(87) PCT Pub. No.: WO2007/042865
PCT Pub. Date: Apr. 19, 2007

(65) Prior Publication Data

US 2009/0269519 A1 Oct. 29, 2009

(30) Foreign Application Priority Data

Oct. 14, 2005 (IT) ..... MI2005A1944

(51) Int. Cl.
*B42D 15/00* (2006.01)

(52) U.S. Cl.
USPC ..... 283/72; 283/91; 283/114

(58) Field of Classification Search
USPC ..... 283/114, 91, 94, 96–97
See application file for complete search history.

(56) References Cited

U.S. PATENT DOCUMENTS

| | | | | |
|---|---|---|---|---|
| 4,943,093 | A * | 7/1990 | Melling et al. | 283/91 |
| 5,093,184 | A | 3/1992 | Edwards | |
| 5,516,153 | A * | 5/1996 | Kaule | 283/91 |
| 5,766,738 | A | 6/1998 | Phillips et al. | |
| 6,082,778 | A * | 7/2000 | Solmsdorf | 283/94 |
| 6,382,677 | B1 * | 5/2002 | Kaule et al. | 283/107 |
| 6,491,324 | B1 * | 12/2002 | Schmitz et al. | 283/94 |
| 6,688,221 | B1 * | 2/2004 | Kaule | 101/129 |
| 7,037,606 | B2 * | 5/2006 | Heim | 283/91 |
| 7,040,663 | B1 * | 5/2006 | Plaschka et al. | 283/72 |
| 2004/0028905 | A1 | 2/2004 | Phillips et al. | |

(Continued)

FOREIGN PATENT DOCUMENTS

| | | | |
|---|---|---|---|
| EP | 0 610 917 A | | 8/1994 |
| EP | 1291827 | * | 3/2003 |
| WO | WO 2004/030928 A | | 4/2004 |

OTHER PUBLICATIONS

Wikipedia: Reflectivity http://en.wikipedia.org/wiki/Reflectivity.*

(Continued)

*Primary Examiner* — Kyle Grabowski
(74) *Attorney, Agent, or Firm* — Modiano & Partners; Daniel O'Byrne; Albert Josif

(57) ABSTRACT

A security element, comprising at least two contiguous areas having an identical or different coloring which can vary depending on the inclination of the incidence and, therefore, reflection of direct light or depending on the type of incident light. The security element also has a single graphic marking which crosses with continuity the two areas having variable coloring so that the graphic marking straddles the two areas so that it is perfectly aligned, without having discontinuities of any kind. Moreover, the effect of this graphic marking is perfectly visible both when the security element is viewed from the recto and when it is viewed from the verso.

3 Claims, 3 Drawing Sheets

(56) References Cited

U.S. PATENT DOCUMENTS

| | | | | |
|---|---|---|---|---|
| 2005/0012326 | A1* | 1/2005 | Keller et al. | 283/94 |
| 2005/0029800 | A1* | 2/2005 | Disano et al. | 283/91 |
| 2005/0042449 | A1 | 2/2005 | Phillips et al. | |

OTHER PUBLICATIONS

Wikipedia: Reflectivity (Jan. 2005). https://web.archive.org/web/20050121062919/http://en.wikipedia.org/wiki/Reflectivity.*

* cited by examiner

SECURITY ELEMENT FOR BANKNOTES OR DOCUMENTS WITH INTRINSIC VALUE

The present invention relates to a new security element for documents with intrinsic value, such as banknotes, identity documents such as identity cards and passports, documents issued by public authorities, such as driving licenses, and so forth.

BACKGROUND OF THE INVENTION

Each of these documents, and in general any document which represents currency or has an intrinsic value, requires particular solutions aimed at preventing its duplication and counterfeiting.

An evident and well-known example of products which require one or more security elements is constituted by banknotes. As is known, each banknote is in fact provided with characteristic elements, such as watermarked paper which shows symbols or figures which are impressed so that they are visible only if viewed by transmitted light, a silver thread, holograms or others.

Duplicating a banknote, i.e., producing false banknotes, therefore requires knowledge and exact duplication of the methods with which these security elements are provided. Since the main requirement of these security elements remains that they must not be easy to reproduce, very complex production methods have been devised in the course of time which entail an elaborate sequence of steps and the use of elements having particular chemical and physical characteristics. These methods allow to obtain effects, generally optical ones, which are very difficult to reproduce exactly and therefore allow to distinguish a genuine banknote from a counterfeit.

Known types of security elements comprise, for example, security threads, stripes or patches. By way of non-limiting example, the security element according to the invention and the method for obtaining such security element will be described hereinafter in one of its possible applications, i.e., in the field of banknotes. However, it is straightforward for the person skilled in the art to understand that the same considerations apply to any document having similar characteristics.

When a banknote has been circulating for some time, the decision may be taken to replace it with new banknotes of a different type. Gradually, the old banknotes are withdrawn from circulation and replaced by the new banknote. The issue of new banknotes can be decided also because it is deemed necessary to increase the level of security by replacing the banknotes with others of a new kind provided with more sophisticated security elements, produced with techniques which are new, original and difficult to duplicate. In this manner, even if ill-intentioned individuals have succeeded in understanding how to reproduce partially the security elements of the banknotes, the knowledge and the degree of experience acquired by the counterfeiter would not be easily transferable to the new banknotes, provided with the new and more sophisticated security elements.

Currently, most banknotes issued worldwide are provided with a security thread, which is inserted in the paper according to two different techniques, known respectively as "total embedded" and "windows".

With the first technique, known as "total embedded", the thread is inserted completely within the thickness of the paper and therefore the security thread is completely surrounded, on both faces, i.e., recto and verso, by the paper.

With the second technique, known as "windows", the security thread is inserted in the banknote so that it is completely covered by the paper on one face of the banknote whereas on the other side there are regions of the thread which are exposed and are alternated with covered regions of thread with a planned alternation.

Currently, some security threads can have, when viewed, a coloring which can vary depending on the angle of incidence of the light and/or on the type of light that strikes them.

This characteristic is known as "color shift".

The types of thread currently in use may have a color shift provided by means of a so-called thin-film technique. This thin-film technique consists in vaporizing, on the full surface and in vacuum, elements such as magnesium fluoride associated with chromium or aluminum in an extremely low thickness on a polyester substrate. Products manufactured with this technique allow, depending on the amount of material that is vaporized, to view a reflective surface in two different colors depending on the inclination with which light strikes them.

An alternative manufacturing method that is currently used entails providing the color shift effect by means of a pigment-based technique. In this technique, a polyester substrate is printed with inks which contain pigments, liquid crystals, et cetera, which have the property of reflecting colors in two distinct ranges depending on the inclination with which light strikes them. In order to achieve this effect, the pigment must be printed on backgrounds which have very dark colors, typically dark gray or black.

The first production technique described above, known as "thin film", provides full-surface elements from which material is then removed (demetallization) in some areas, particularly at the regions where an etching is to be provided, by way of known kinds of techniques, based on the use of waxes or resist. These areas without material therefore leave graphic markings, for example letters or numerals, depending on where the material is removed. In this manner, it is possible to provide any graphic marking one wishes, as a positive or as a negative.

The second production technique described above, known as "pigment-based technique", instead entails printing the ink on the full surface on a black background which has already been printed selectively, again as a positive or as a negative.

The production methods can be summarized briefly as follows. As regards the thin-film technique, it is possible to print wax-based graphic markings before the vacuum vaporization step, subsequently softening these waxes so that their removal also removes the color-shifting material. As an alternative, it is possible to print in regions above the aluminum vaporization or color-shifting materials a resist which allows to preserve the color-shifting material from acid or basic elements, depending on the process. These acid or basic elements corrode, and therefore remove, the parts of material which are not covered by the resist.

As regards the pigment-based technique, systems are currently used which print the colors sequentially, depositing the image that is to be obtained; for example, texts are printed in negative by using a dark color with the first printing section, followed by the full-surface color-shifting color with the second section.

It is known that in security threads inserted in banknotes, the side that remains inserted within the paper of the banknote, i.e., the side which lies opposite the windows described earlier if the security thread is inserted with the window technique, must be very light in color, for example white or straw yellow, or highly reflective, such as aluminum. This is needed in order to obtain the well-known effect of making the thread inserted in the banknote practically invisible when viewed by reflected light and by viewing the face in which it is fully inserted within the paper of the banknote, obtaining at the same time maximum opacity when the same face of the banknote is viewed by transmitted light, i.e., against the light. With the techniques known up to now, it is not possible to print, for example, the following sequence of colors: with a first section, an aluminum gray color which has texts in negative; with a second section, a black color which has the same texts in negative; and then another pair of additional colors with a third section and a fourth section (or, worse still, with a second pass), which have the same texts in negative exactly superimposed on the first two. By viewing by transmitted light from the recto and from the verso the texts printed in negative, the colors printed with the first section and the colors of the third and fourth sections must not allow to see that inside the multilayer element there is the black color printed with the second section.

SUMMARY OF THE INVENTION

The aim of the present invention is to provide a new security element which is more sophisticated than currently known ones, so as to further increase the difficulty of duplication by ill-intentioned individuals who wish to duplicate value-bearing documents and/or produce counterfeit banknotes.

Within this aim, an object of the present invention is to allow easier and more certain identification of a counterfeited document.

Another object of the present invention is to provide a method for manufacturing said security element which can be performed at low costs with respect to the techniques already in use.

This aim and these and other objects, which will become better apparent hereinafter, are achieved by a security element, characterized in that it comprises:

at least one supporting element, on which there are at least two contiguous elements which are superimposed or arranged side-by-side, so that at least one contact region is formed between them, each one of the at least two contiguous elements having a color which can vary depending on how much light they absorb and reflect and on the inclination with which light strikes them, and at least one graphic marking provided on the security element, at least one part of said at least one graphic marking being provided at said region of contact between said contiguous elements, said at least one graphic marking being arranged so as to pass through said contiguous elements and being at the same time perfectly visible and mirror-symmetrical both when viewed from the recto in transmitted light and when viewed from the verso in transmitted light.

BRIEF DESCRIPTION OF THE DRAWINGS

Further characteristics and advantages of the present invention will become better apparent from the following detailed description, given by way of non-limiting example in the accompanying figures, wherein.

DESCRIPTION OF THE PREFERRED EMBODIMENTS

Figure 1:
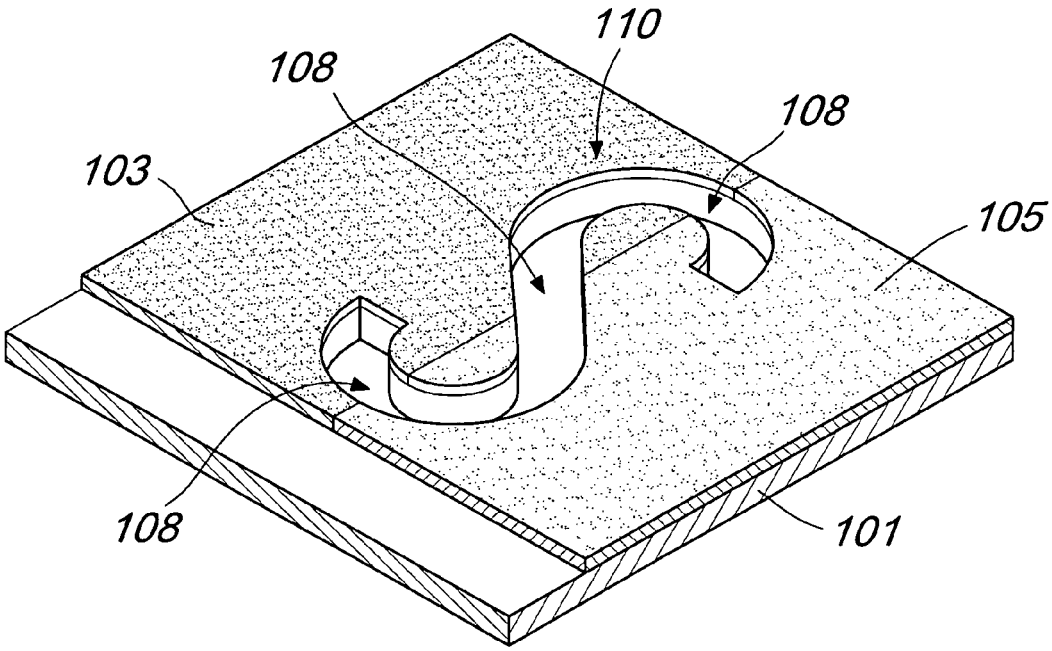
FIGS. 1 and 2 are views of two possible embodiments of the security element according to the invention.

A first embodiment of the invention having the described characteristics can be obtained by using a substrate made for example of clear polyester of suitable thickness, on which a series of soluble alkaline inks is deposited, such as for example, with the first section, full-surface aluminum-colored ink composed by a carboxylated acrylic resin, on which the second section deposits, again on the full surface, another ink, for example black ink composed of a styrene maleic resin. In the case being considered, in which the security element is used for banknotes, the thickness of the polyester must be on the order of microns, preferably ranging from approximately 6 to 60 microns, so that the security element can be inserted in the banknote. Likewise, in this specific case the amount of ink to be deposited is preferably approximately 1.3 $g/m^2$ for the aluminum-colored ink deposited with the first section and preferably approximately 2.5 $g/m^2$ for the black ink deposited with the second section.

Alternating lines or regions which are longitudinally or transversely elongated or mutually parallel are then printed on the resulting foundation by using a different pigment for each one, by means of a third section and a fourth section (if available) or by means of a second pass; this sequence (3 and 4) occurs with a normal rotary printing machine which can print colors in register. To ensure that there is color continuity between the two colors printed by using two printing sections (although this is not indispensable), it is sufficient to ensure that there is a slight overlap between them. The inks used in the third and fourth sections are composed of two colors which are mixed advantageously in a styrene maleic resin. In this case, the amount of ink is advantageously approximately 3 $g/m^2$.

At this point, one has a polyester film on which a solid background of aluminum-colored ink has been printed with the first section, a solid background of black ink has been printed with the second section, a band or area or region has been printed by means of the third section with ink which shifts color from green to magenta, and another strip or area or region which is adjacent to the region provided earlier and is printed with an ink which shifts color from blue to gold by means of the fourth section. This foundation is then overprinted with a film of clear varnish, provided for example by means of a nitrocellulose resin which is conveniently integrated with other special elements, is deposited selectively and acts as resist. This clear varnish is deposited so as to form, as a negative or positive, the selected distinctive marking, which will be continuous astride the contiguous strips, areas or regions. In particular, there will be regions where the clear varnish has been deposited and which therefore are protected by the resist, and regions in which said varnish is absent. The film thus prepared is immersed continuously in a series of tanks in order to dissolve and therefore corrode and remove the parts which are not covered by the resist constituted by the clear varnish.

For example, the sequence of steps which leads to the production of the security element according to the invention is described hereinafter merely by way of example. For a production rate of approximately 50 meters per minute, one can proceed with a first tank which contains warm water at 45° C. in a 1% sodium carbonate solution, so that the film remains immersed for a period which is calculated to be approximately 20 seconds. A second tank contains demineralized water for washing, and a third tank contains water with a neutral pH in a quantity which is sufficient to return the pH of the substrate to a neutral value. Finally, a further final wash is performed in a fourth tank which contains demineralized water. At the end of these steps, in tanks, the film is dried and rewound.

The resulting security film therefore has transparent regions which form a graphic marking when viewed from the recto and from the verso by transmitted light.

Thanks to the production method, graphic markings printed in negative or positive with the special resist cross with perfect continuity the two bands or regions or areas or lines having different colors. At the same time, when the thread is viewed from the verso by reflected light, owing to the polyester foundation on which the aluminum-colored ink is deposited, when the thread is viewed from the verso, as said, it has a single color (in this case aluminum), and has areas which are completely free from these inks, and are therefore transparent, when it is viewed by transmitted light.

The graphic markings observable on the recto by reflected light are perfectly superimposed with respect to the ones observable by transmitted light when the thread is viewed from the verso. This phenomenon is achieved thanks to the composition of the ink used in the first section (carboxylated acrylic resins), which has the characteristic of excellent grip on the polyester onto which it is printed and of allowing at the same time the second ink, based on styrene maleic resin, to be overprinted without softening problems by using the second section. The other two inks used in the third and fourth sections have characteristics which are similar to those of the second section, since the main resin is the same; in this case, by way of some printing refinements (speed, pressure, hardness of the presser rollers, et cetera) they can be applied by regions without softening the previous layer (the second one). The overprinting of the resist varnish occurs by using particular rotogravure rollers which allow very low quantities (grams per square meter) while having excellent definition besides allowing good spreading of the product.

At this point, the production method requires the use of rollers which have large diameters for transporting the film, so that it does not slip and consequently does not ruin the surface of the resist. The first meters of insertion in the tank, with sodium carbonate, are in fact the most delicate ones, since there must be no kind of thermal or mechanical shock in order to allow the sodium carbonate to penetrate and dissolve the resins down to the polyester without ruining the resist which acts as a protective agent. At the end of the "washing" cycle, graphic markings are therefore achieved which are completely free from inks and are therefore transparent. These graphic markings, if viewed in an imaginary cross-section, have different colors and thicknesses, as if they had been simultaneously cut and sectioned. One difficulty in obtaining the effects described so far is due to the need to deposit layers of different colors and types to allow the color-shifting inks to perform their task in the best possible way, since without the underlying black color their effect would be reduced greatly.

As mentioned earlier, the techniques for providing the security element according to the present invention may be various.

Among the known methods used to produce security elements characterized by the presence of graphic markings, methods have already been mentioned which comprise printing the graphic marking by means of waxes before the vacuum vaporization step. These waxes are then softened so that the wax can be removed. By removing the wax, the color-shifting material is also removed, obtaining the intended graphic marking.

With reference to FIGS. 3 to 9, in this case also the process starts from a substrate 101 made of suitable material, advantageously polyester, on which a region or strip 102 of water-soluble or heat-soluble ink is deposited, arranging itself laterally adjacent to a region or strip 106 which remains empty.

Figure 7:
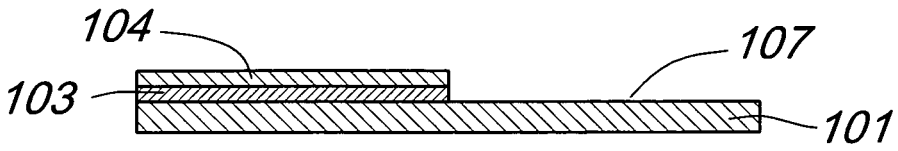

At this point, the reel in this form is metalized with aluminum, which is deposited in vacuum on the full surface. In this manner, a layer of aluminum 103 is obtained, which is deposited directly on the polyester substrate 101, and an aluminum layer 103 is deposited on the layer of soluble ink 102, FIG. 5. At this point, with an additional pass in a tank which contains warm water at a temperature of approximately 50° C., the soluble ink is reactivated, removing the aluminum which is deposited thereon, while the aluminum 103 deposited directly on the polyester substrate 101 remains intact, FIG. 6. With reference to FIG. 7, the layer of aluminum 103 is then overprinted with soluble ink 104, taking care not to deposit said ink on the empty polyethylene strip 107.

Figure 8:
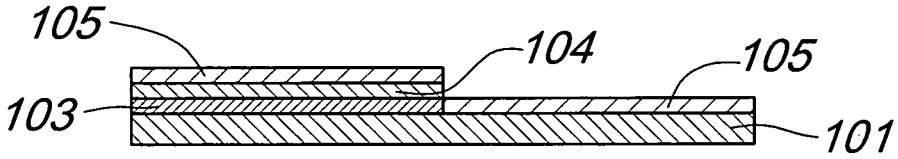
Figure 9:
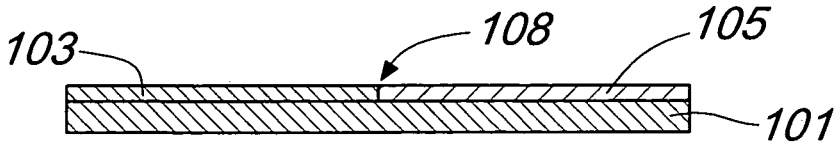

A further vacuum metalization is then performed, depositing this time copper 105, FIG. 8. At the end of this metalization step, FIG. 8, one has therefore a reel which has on one side the copper 105 deposited directly on the polyester substrate 101, while on the adjacent strip above the aluminum 103 and below the copper 105 there is the layer of soluble ink 104. By reactivating the soluble ink 104, the layer of copper 105 is removed from the underlying layer of aluminum 103, while the layer of copper 105 deposited directly on the polyester substrate 101 is not affected. At the end of the process, therefore, one has an element constituted by a polyester substrate 101 on which a layer of aluminum 103 and a layer of copper 105 are deposited side by side, as shown in FIG. 9.

Figure 2:
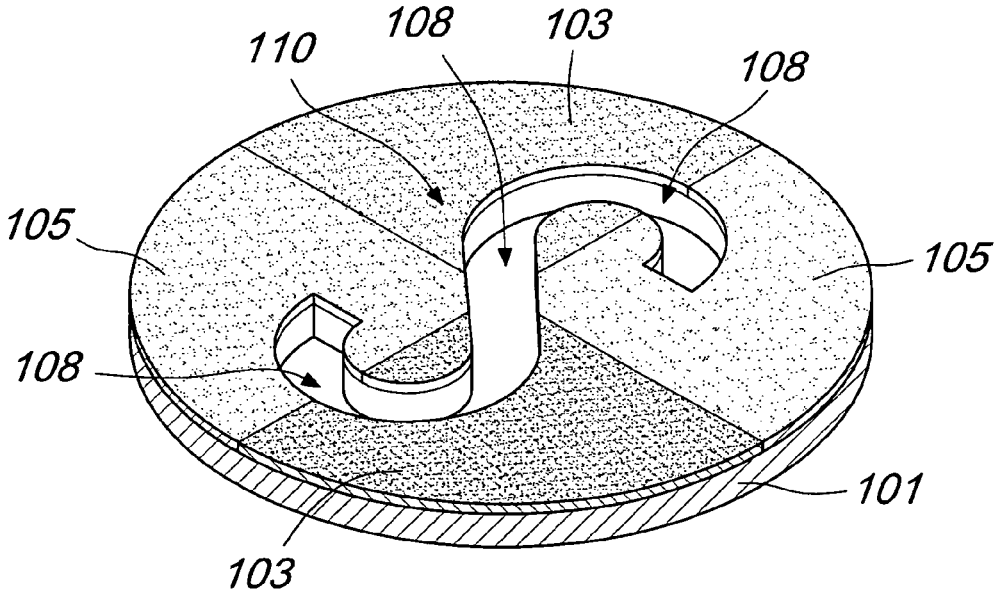
Figure 3:
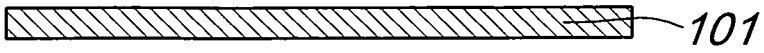
FIGS. 3 to 9 are schematic views of the steps of deposition of the materials on a substrate, made for example of polyester, in order to obtain the security element according to the present invention.
Figure 4:
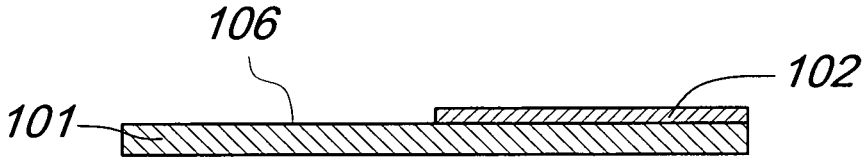
Figure 5:
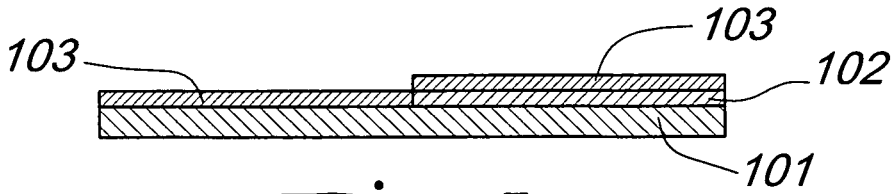
Figure 6:
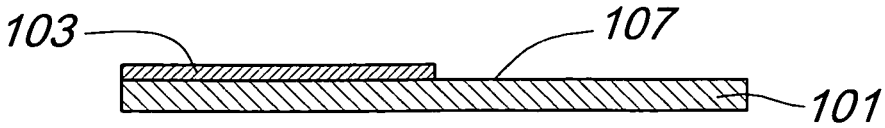

From the description of the process it is evident that any number of contiguous elements can be deposited on a security element by means of this technique. FIG. 2 shows that for each pair of contiguous elements it is possible to identify a contact or border region 108.

FIGS. 1 and 2 illustrate by way of example two possible embodiments of the security element according to the invention. The graphic marking 110 has an extension which affects the contiguous bands 103 and 105 and has at least one part which is provided at the region of contact 108 between the contiguous elements. While FIG. 1 illustrates an embodiment with two contiguous bands, FIG. 2 illustrates an example of an alternative embodiment of the security element according to the invention, in which the elements are four in number.

In the embodiment of FIG. 2, the contiguous elements 103 and 105 can all be made of different materials, or of the same material in noncontiguous positions, as indeed shown in FIG. 2, in which contiguous elements are in any case made of different material and/or of material having different light reflection properties. Any material (both metallic ones, such as aluminum or copper or nickel et cetera, and/or pigment-based ones, such as pearlescent and color-shifting materials et cetera) which has properties which are equivalent to what has been described is of course adapted to be used in the method herein described.

It is now possible to perform the step of stripping the graphic marking or markings that straddle the two bands or strips of different color. In particular, one characteristic of the invention consists in providing a graphic marking which also affects the region of contact 108 between two contiguous bands, so that said graphic marking is continuous also at said contact region 108. By depositing on both bands of the areas covered by resist based on nitrocellulose and by immersing the whole unit in a suitable bath, based for example on phosphoric acid at 45° C. with 52% dilution, the areas without resist are removed, forming graphic markings which can be viewed both from the recto and from the verso in transmitted light.

The provision of graphic markings on color-shifting material by using resist, obtained by vacuum deposition of materials such as magnesium fluoride, silicon, and the like, is known only when the graphic markings are provided on full-surface color-shifting material (where "color-shift" designates shift from a primary color to a secondary color, i.e., green to magenta, blue to green, green to gold, et cetera). In order to obtain these pairs of colors, there are several methods, which range from different materials deposited in multiple passes to materials which are identical but have different thicknesses on the order of a few tens of nanometers, the entire unit being then covered with aluminum of extremely low thickness. Up to now, no method is known which allows to deposit two parallel bands or two contiguous areas made of color-shifting materials obtained by vacuum deposition of different materials or identical materials having different thicknesses.

In particular, it is not known that in order to remove materials such as magnesium fluorides, in addition to aluminum, one must use strongly basic and strongly acid solutions, obviously protecting the particular characteristics of each element so that they are not compromised by using a single resist which determines the graphic marking.

An equally effective alternative method for obtaining the bands, areas or regions with different color-shifting characteristics comprises the vacuum deposition on polyester of materials comprised among the ones described hereinafter, the quantities being indicated as an example of a possible embodiment:

Cr=5 nm $MgF_2$=approximately 500 nm

Al=30 nm

At this point, the bands, areas or regions are protected by rotogravure printing with at least 2 g/m$^2$ of resist which is resistant to acid and easily soluble in an alkaline environment. The film is immersed in phosphoric acid at 45° C. at 52% concentration so as to dissolve the aluminum where there is no resist. At this point the film is immersed in a $Na_2CO_3$ solution at a concentration of 0.6-0.8% at 35-40° C., so as to remove the magnesium fluoride and the chromium, leaving a small quantity of resist (approximately 0.6-0.8 g/m$^2$).

At this point, the film returns to the vacuum metalization unit in order to deposit:

$ZrO_2$=75 nm $SiO_2$=300 nm

Al=30 nm

The material thus deposited goes on top of the preceding regions, where there is chromium, fluoride and aluminum, and also in to the regions where these materials have been removed, and therefore in the regions without material. Viewing the film from the polyester side, one therefore has bands, regions or areas which have regions with color-shifting effects which differ depending on where one deposit or the other is present. The special resist which withstands both acid and basic solutions is deposited at this point on both bands, regions or areas and therefore astride said regions, in order to allow to remove both deposited materials.

The methods described above therefore allow to identify multiple industrial solutions which have in common at least two bands, areas or regions covered by materials which have specific color variations crossed by graphic markings which can be visible by viewing by transmitted light.

It is also evident that the same result, in some cases, can be achieved for example by using controlled laser beams, which produce the sublimation of the color-shifting materials. In this case, the low production rate, however, increases the production cost of the product, limiting the possibilities of its use.

It has thus been shown that the present device achieves the intended aim and objects. In particular, a method has been described which allows to make it extremely difficult to forge and counterfeit documents with intrinsic value, particularly banknotes. Numerous modifications can be made by the person skilled in the art without abandoning the scope of the protection of the present invention.

Therefore, the scope of the protection of the claims must not be limited by the illustrations or by the preferred embodiments shown in the description by way of example, but rather the claims must comprise all the characteristics of patentable novelty which can be deduced from the present invention, including all the characteristics that would be treated as equivalent by the person skilled in the art.

The security element according to the invention can be for example a security thread, security stripe, a security patch and the like.

The disclosures in Italian Patent Application no. MI2005A001944, from which this application claims priority, are incorporated herein by reference.

What is claimed is:

1. A security element, comprising:

at least one supporting element, on which there are at least two contiguous elements which arranged side by side, so that at least one contact region is formed between them, each one of said at least two contiguous elements having a color which can vary depending on how much light they absorb and reflect and on the inclination with which light strikes them, and at least one graphic marking provided on said security element, at least one part of said at least one graphic marking being provided at said region of contact between said contiguous elements, said at least one graphic marking being arranged so as to pass through said contiguous elements, crossing said region of contact between said contiguous elements and extending into said at least two contiguous elements with perfect continuity, and wherein the graphic marking when viewed from the recto in transmitted light is mirror-symmetrical to the graphic marking when viewed from the verso in transmitted light, said contiguous elements being provided by inks;

said at least two contiguous elements being slightly overlapped.

2. A security element according to claim 1, wherein said at least two contiguous elements have different light reflection properties in the visible-light range (wavelength 400-800 nm), in the ultraviolet range (wavelength 254-370 nm) and in the infrared range (wavelength >820 nm).

3. A method for manufacturing a security element, comprising the steps of:

providing a substrate film;

obtaining, on said substrate, two contiguous, laterally adjacent bands or regions, which have a coloring which shifts depending on the light that strikes them, said bands or regions being provided by inks;

depositing on both contiguous bands or regions a material which acts as resist, taking care to leave a region without resist which forms a chosen graphic marking and affects both contiguous regions, said graphic marking having at least one part which affects both contiguous bands or regions and crossing a region of contact between said contiguous elements and extending into at least two said contiguous bands or areas;

immersing the film thus obtained in a series of tanks, which contain acid or basic solutions depending on the materials used, in order to dissolve and remove the parts not covered by the resist, providing the intended graphic marking, wherein said two contiguous regions are slightly overlapped.

* * * * *